US009387357B2

(12) United States Patent
Mueller

(10) Patent No.: US 9,387,357 B2
(45) Date of Patent: Jul. 12, 2016

(54) SEAT COVER EXERCISE DEVICE

(71) Applicant: Boris Mueller, Nyack, NY (US)

(72) Inventor: Boris Mueller, Nyack, NY (US)

( * ) Notice: Subject to any disclaimer, the term of this patent is extended or adjusted under 35 U.S.C. 154(b) by 0 days.

(21) Appl. No.: 14/267,869

(22) Filed: May 1, 2014

(65) Prior Publication Data

US 2015/0314162 A1 Nov. 5, 2015

(51) Int. Cl.

| | |
|---|---|
| ***A63B 21/04*** | (2006.01) |
| ***A63B 21/16*** | (2006.01) |
| ***A63B 21/00*** | (2006.01) |
| ***A63B 23/035*** | (2006.01) |
| ***A63B 21/055*** | (2006.01) |

(52) U.S. Cl.

CPC ..... *A63B 21/16* (2013.01); *A63B 21/0442* (2013.01); *A63B 21/0557* (2013.01); *A63B 21/1469* (2013.01); *A63B 21/1484* (2013.01); *A63B 23/035* (2013.01); *A63B 2021/1609* (2013.01)

(58) Field of Classification Search

CPC ..... A63B 21/0552; A63B 21/0442; A63B 21/0557; A63B 21/1469; A63B 2210/50; A63B 21/04; A63B 21/00065; A63B 23/03575; A63B 21/055; A63B 21/0555; B60N 2/5825; B60N 2/58; B60N 2/5816; B60N 2/682; B60N 2/7005

USPC ..... 482/129; 297/218.3

See application file for complete search history.

(56) References Cited

U.S. PATENT DOCUMENTS

| | | | | | |
|---|---|---|---|---|---|
| 4,328,964 | A * | 5/1982 | Walls | A63B 21/04 | 473/229 |
| 4,396,227 | A | 8/1983 | Neilson | | |
| 5,141,482 | A * | 8/1992 | Hern | 482/130 | |
| 5,277,683 | A * | 1/1994 | Wilkins | 482/129 | |
| 5,431,617 | A * | 7/1995 | Rattray, Jr. | A63B 21/04 | 482/121 |
| 5,468,205 | A * | 11/1995 | McFall et al. | 482/129 | |
| 5,605,526 | A * | 2/1997 | Hatfield | 482/142 | |
| 5,743,838 | A * | 4/1998 | Willis | 482/124 | |
| 5,885,196 | A * | 3/1999 | Gvoich | A63B 21/0004 | 482/122 |
| 6,089,659 | A * | 7/2000 | Toyota | 297/228.11 | |
| 6,110,081 | A * | 8/2000 | Barrett | 482/121 | |
| 6,117,056 | A * | 9/2000 | Cataldi et al. | 482/121 | |
| 6,461,283 | B1 * | 10/2002 | Maron | 482/123 | |
| 6,634,998 | B2 * | 10/2003 | Siaperas | 482/142 | |

(Continued)

*Primary Examiner* — Loan H Thanh
*Assistant Examiner* — Andrew S Lo
(74) *Attorney, Agent, or Firm* — Guntin & Gust, PLC; Atanu Das

(57) ABSTRACT

An exercise device is disclosed comprising a flexible seat cover capable of conforming to a seat, the seat having a horizontal seat portion and a vertical back portion. The device further includes a plurality of exercising resistance members, each having a first end and a second end and one or more fasteners coupled to each first end of each of the plurality of exercising resistance members. The exercise device, when installed on a seat, enables a user seated thereon to engage in resistance exercises by grasping said grip and extending said exercising resistance member.

20 Claims, 13 Drawing Sheets

(56) References Cited

U.S. PATENT DOCUMENTS

| | | | | |
|---|---|---|---|---|
| 6,712,745 | B1 | 3/2004 | Lynne | |
| 7,431,681 | B1 * | 10/2008 | St. Cyr | A63B 21/0552 482/121 |
| 8,162,809 | B1 * | 4/2012 | Eastwood | 482/123 |
| 8,784,285 | B1 * | 7/2014 | Lopez et al. | 482/129 |
| 2002/0187884 | A1 * | 12/2002 | McGrath | A63B 21/0552 482/121 |
| 2005/0009673 | A1 * | 1/2005 | Harris | A63B 21/04 482/129 |
| 2006/0105893 | A1 * | 5/2006 | Chen | A63B 21/0004 482/126 |
| 2009/0163336 | A1 | 6/2009 | Mueller | |
| 2013/0190148 | A1 * | 7/2013 | Allison et al. | 482/129 |
| 2014/0191544 | A1 * | 7/2014 | Comber, V | 297/224 |
| 2014/0323271 | A1 * | 10/2014 | Hinds | A63B 21/0442 482/8 |

* cited by examiner

SEAT COVER EXERCISE DEVICE

FIELD OF THE INVENTION

Embodiments of the present disclosure generally relates to the field of exercise devices. Further, embodiments of the present disclosure relate more particularly to exercise devices having a plurality of resistance members.

BACKGROUND

Sedentary lifestyles constitute a major health risk for Americans, who increasingly spend extended periods in seated positions with little or no opportunity for physical activity. The importance of physical activity to well-being and longevity is well established by medical science. Individuals who have insufficient physical exercise suffer from mental and physical strain, fatigue, and general deconditioning.

Numerous exercise devices exist to combat the risks of sedentary living. However, most exercise devices require the user to be in an exercise location, such as a gym. Few exercise devices meet the needs of individuals who are unable to commit fixed space or time to physical exercise. Accordingly, there remains a need for exercise devices that provide stimulating physical activity to individuals who are seated for extended periods. Such exercise devices should be portable, affordable and adaptable to standard seating arrangements. Moreover, such devices should provide effective and varied forms of exercise to individuals, without interfering with the individuals' normal seated activities.

SUMMARY

Embodiments of the present disclosure provide a portable exercise device, in the form of a seat cover that can be placed around various types of seats. Attached and integrated into the seat cover are various resistance members, such as elastic bands, and exercise tools that permit individuals to perform a variety of exercises while seated.

In one embodiment, the portable exercise device includes a flexible seat cover, which is capable of conforming to a seat that has a horizontal seat portion and a vertical back portion. Also included is one or more resistance members, such as an elastic band. One end of the resistance member is attached to the seat cover and the other end of the resistance member is attached to a grip or a strap. When the exercise device is installed on a seat and a user is seated therein, the user may engage in resistance exercises by grasping the grip or attaching the strap to the lower leg and extending the resistance member.

Variations in the resistance members' points of attachment to the seat cover and the user's motions permit the user to exercise his or her arms, hands, trunk, abdomen and/or legs while seated. By providing for attachment of resistance members from the back or underside of the seat cover, the grips/straps are made accessible at a variety of locations around the perimeter of the seat cover. A large number of exercises can be performed by using these variously positioned grips/straps, as well as additional exercise tools that are attached to or included with the seat cover. The degree of resistance in the resistance members can be varied to suit the needs of the user.

BRIEF DESCRIPTION OF THE FIGURES

The accompanying drawings, which are incorporated in and constitute part of this specification, illustrate embodiments of the invention and together with the description serve to explain the principles of the present disclosure. The embodiments illustrated herein are presented as examples, it being understood, however, that the invention is not limited to the precise arrangements and instrumentalities shown, wherein.

DETAILED DESCRIPTION OF THE INVENTION

Figure 1:
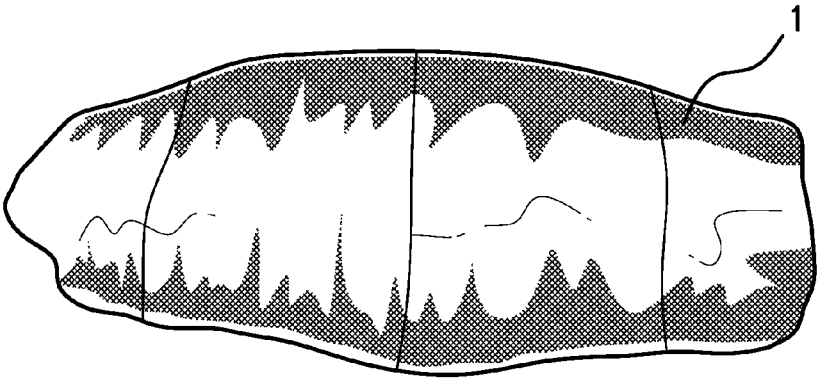
FIG. 1. is a front view of the seat cover exercise device (unattached to a seat) lying on a flat surface.

The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of difference configurations, all of which are explicitly contemplated herein. Further, in the foregoing description, numerous details are set forth to further describe and explain one or more embodiments. These details include system configurations, block module diagrams, flowcharts (including transaction diagrams), and accompanying written description. While these details are helpful to explain one or more embodiments of the disclosure, those skilled in the art will understand that these specific details are not required in order to practice the embodiments.

Embodiments of the present disclosure describe a portable exercise device in the form of a seat cover that can fit various types of seats. Attached and integrated into the seat cover are various resistance members and exercise tools that allow individuals to perform a variety of exercises while seated.

The seat cover element of the exercise device preferably is constructed with a portion that fits around and conforms to the vertical back portion of a seat and a portion that fits around and conforms to the horizontal seat portion of a seat. In particular embodiments, the seat cover element is dimensioned to fit an automobile seat, an office chair, a wheelchair or any other chair that individuals may be seated for prolonged periods of time during working or sedentary time periods. The seat cover element can be constructed of durable and flexible material, such as leather, vinyl, nylon or canvas. The material should be capable of withstanding the repetitive force of resistance members pulling against it during use.

One or more resistance members attaches to the seat cover element. The resistance members preferably are elongated and extensible. Preferred resistance members also are flexible and elastic. Exemplary resistance members are elastic bands (e.g., bungee cords and rubber surgical-type tubing) and resilient springs as well as other materials known in the art. In one embodiment, resistance members also could comprise a piston that provides resistance. The force required to extend a resistance member may be varied through one or more force varying mechanisms to suit the needs of particular users. Similarly, the length of resistance members can be varied to better accommodate individuals of different size and to accommodate different exercise activities.

One end of each resistance member (herein referred to as the proximal end) attaches to the seat cover. Different embodiments may have the attachment be permanent or be removable. In such embodiments the point of attachment is on the underside/back of the seat cover. Such a location for the point of attachment provides stability during use of the exercise device. In a further embodiment, the point of attachment is a bracket which is attached to a belt that passes through the mid-section of the seat cover and wraps around the seat.

A second end of each resistance member (herein referred to as the distal end) attaches to a grip. The grip may be designed for a user's arms and legs. In some embodiments, the grip may take the form of a handle or loop that a user can grasp by hand. In other embodiments, the grip may take the form of a stirrup that can attach to a user's foot. In additional embodiments, the handle may take the form of a band or brace that can be wrapped around a user's wrist, arms, ankle, thigh or leg. The grip may removably attach to the seat cover or seat, for storage when not in use.

By providing for attachment of resistance members from the back/underside of the seat cover, grips can be made accessible at a variety of locations around the perimeter of the seat cover. Upon installation of the exercise device in a seat having a horizontal seat portion and a vertical back portion, resistance members may extend in multiple directions from their point of attachment, to accommodate users performing a variety of exercises. In one embodiment, a resistance member extends from its point of attachment laterally along the side of the horizontal seat portion of the seat to perform biceps exercises. In another embodiment, a resistance member extends from its point of attachment laterally along the side of the vertical back portion of the seat. In another embodiment, a resistance member extends from its point of attachment across the underside of the horizontal seat portion of the seat to perform leg exercises. In a further embodiment, a resistance member extends from its point of attachment across the top of the vertical back portion of the seat to perform triceps/shoulder exercises.

The present disclosure also includes embodiments that include a kit that comprises the seat cover exercise device described herein as well as a monitor capable of measuring a user's vital signs. The monitor may measure, for example, a user's blood pressure, heart rhythm or heart rate. The kit also may include additional exercise tools, such as ankle and wrist weights and hand grip exercisers.

FIG. 1 depicts a front view of one embodiment of the seat cover exercise device 1, unattached to a seat, rolled/folded lying on a flat surface. As can be shown in FIG. 1, the seat cover device is portable such that a device can be taken to any location to be installed on any seat. Thereby, reducing a need for a user of the seat cover exercise device to go to a dedicated location to exercise such as a gym.

Figure 2:
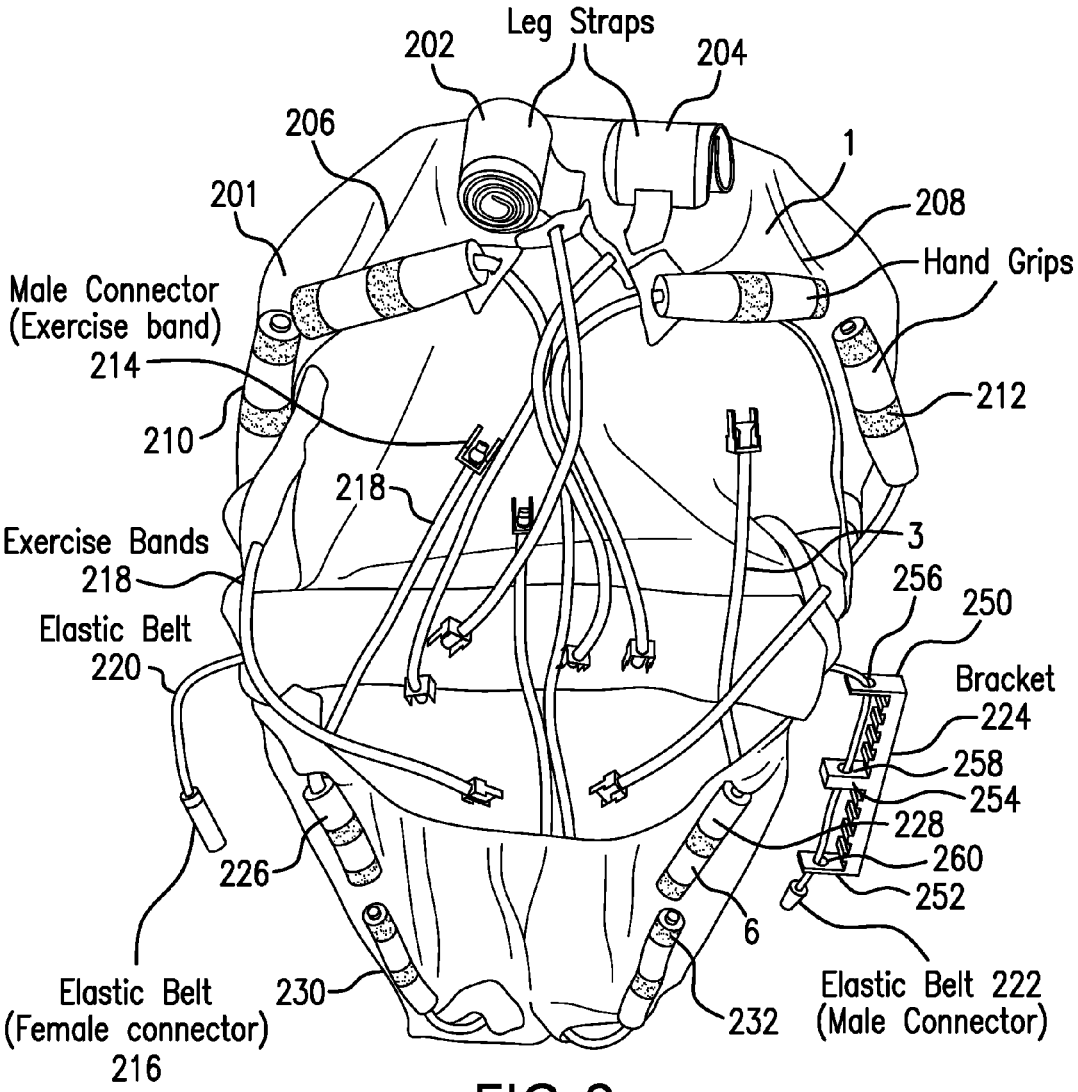
FIG. 2 is a rear view of the seat cover exercise device (unattached to a seat) lying on a flat surface.

FIG. 2 depicts a rear view the seat cover exercise device 201 in one embodiment. The device comprises a flexible seat cover 1 capable of conforming to a seat having a horizontal seat portion and a vertical back portion. A grip 6 is attached to the distal end of resistance members 3.

In further reference to FIG. 2, the exercise device 201 further comprises two leg straps (202 and 204) coupled to leg resistance members or leg exercise bands. In addition, grips (210 and 212) are coupled to biceps resistance members or biceps exercise bands. Moreover, grips (226 and 228) are coupled to chest resistance members or chest exercise bands. Also, grips (206 and 208) are coupled back resistance members or back exercise bands. Further, grips (230 and 232) are coupled to triceps resistance members or triceps/shoulder exercise bands. The resistance members or exercised bands are used to exercise the corresponding body part. For example, the triceps/shoulder resistance members are able to exercise the triceps/shoulder muscles of the user by having the user grasp the corresponding grips (230 and 232) and extending their triceps the stretching limit of the triceps/shoulder resistance members.

In addition, each exercise band is coupled to a male connector 214 that is coupled to the bracket 224 to keep the resistance members in places but at the same time allowing the resistance members to be stretched so that the user can exercise the corresponding muscles. Further, exercise device 201 includes an elastic belt 220 that has a female connector 216 and a male connector 222 that can be coupled together to form a loop to wrap around the back or underside of a chair or seat to secure the exercise device 201 in place.

Figure 3:
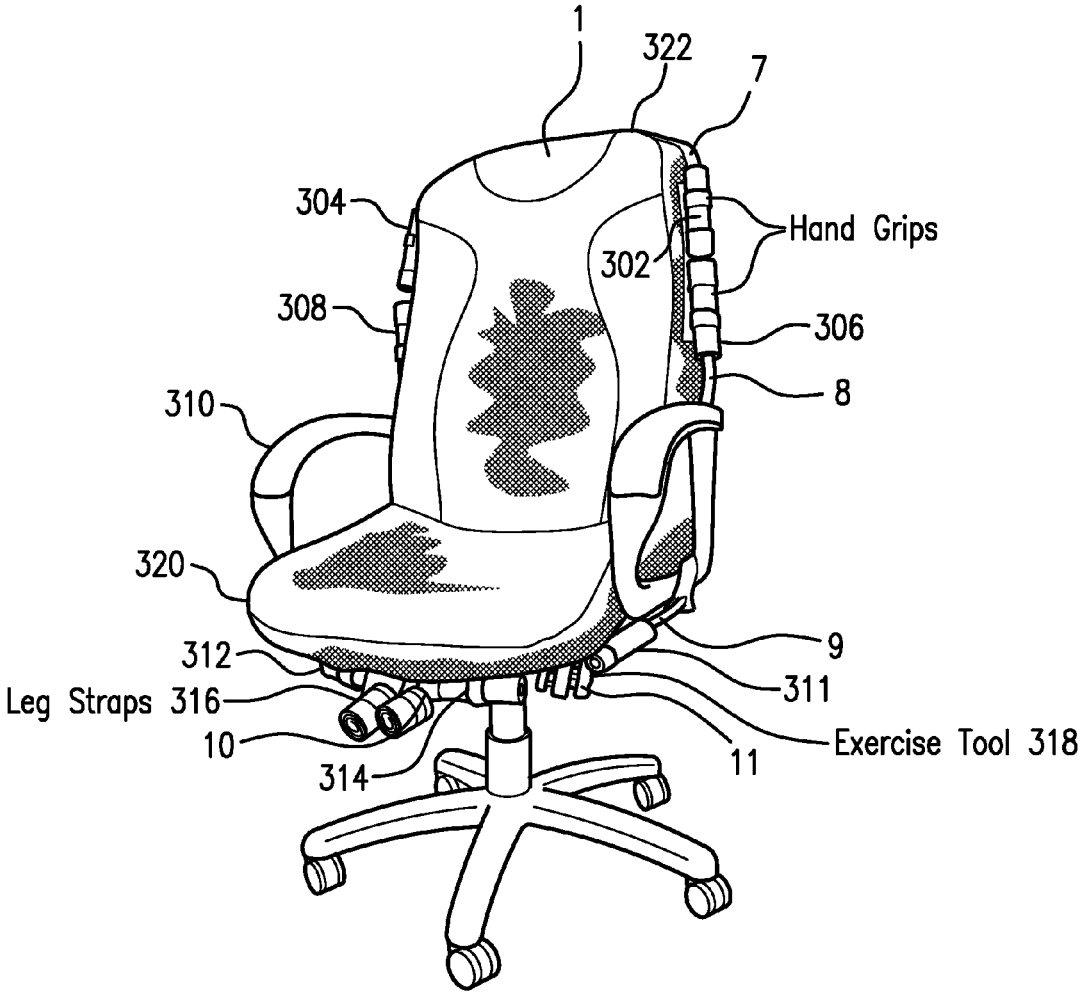
FIG. 3 is a front view of the seat cover exercise device installed on a seat.

FIG. 3 depicts a front view of one embodiment of the seat cover exercise device installed on a seat 10. Attached to the flexible seat cover or exercise device (1) are 10 resistance members: two triceps/shoulder resistance members for triceps/shoulder exercises are accessible at a user's shoulder level (7) using grips (302 and 304), two chest resistance members for chest exercises are accessible at a user's chest level (8) using grips (306 and 308), two bicep resistance members for biceps exercises are accessible at a user's thigh level (9) using grips 311 and two back resistance members for back exercises are accessible at a user's knee level from underneath the seat (10) using further grips (312 and 314), and resistance members for leg exercises from underneath the seat. Attached to the distal end of each resistance member is a grip, which may be removably attached to the seat cover. Also removably attached to the seat cover is a hand grip tool (318, 311). In addition, the exercise device 1 includes leg straps 316 that can be wrapped around a user's legs and connected to resistance members to facilitate the exercising of the user's legs.

Figure 4:
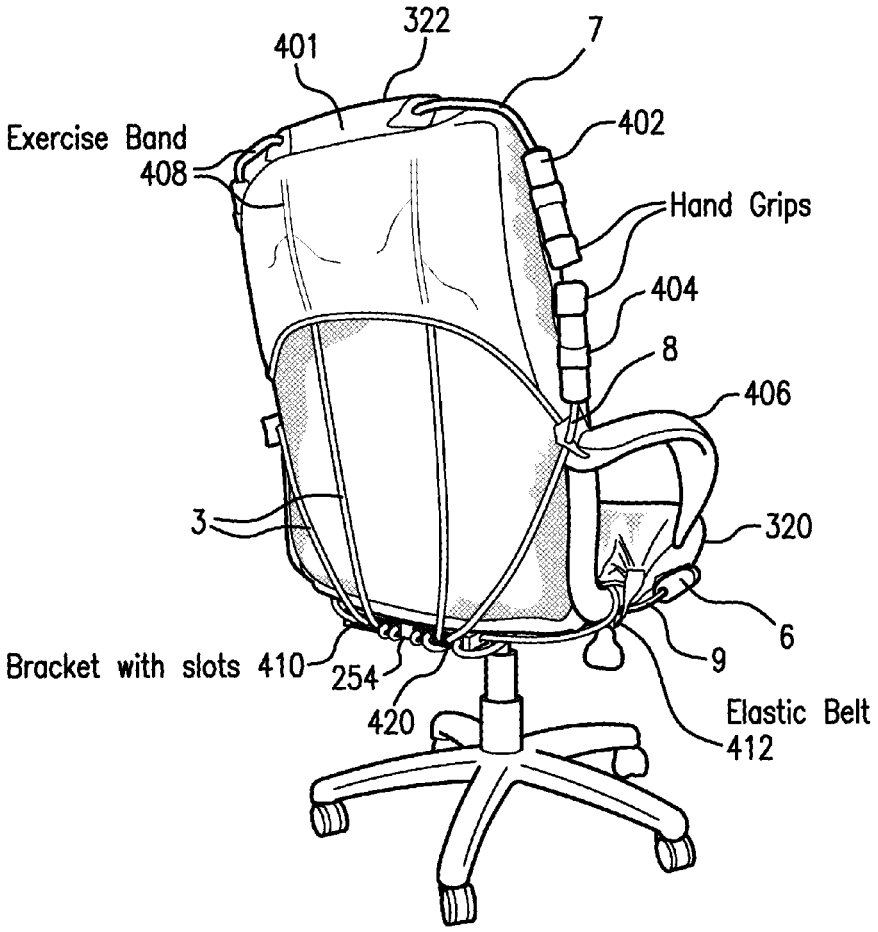
FIG. 4 is a rear view of the seat cover exercise device installed on a seat.

FIG. 4 depicts a rear view of one embodiment of the seat cover exercise device 401 installed on a seat/chair 406. Attached to the flexible seat cover exercise device 401 are 10 resistance members. Six of the ten resistance members are visualized in this figure: two triceps resistance members for triceps/shoulder exercises are accessible at a user's shoulder level (7) using grips 402, two chest resistance members for chest exercises are accessible at a user's chest level (8) using grips 404, two biceps resistance members for biceps exercises are accessible at a user's thigh level (9) using grip 6. Resistance members are coupled to a bracket 410 having slots using one or more connectors. A grip is attached to the distal end of each resistance member. The bracket is attached to an elastic belt 412, which travels through the mid-section of the seat cover and forms a loop to wrap the exercise device 401 around the chair or seat 406. Further, in references to FIGS. 1-4, a flexible seat cover 401 configured to conform to a seat, the seat having a horizontal seat portion 320 and a vertical back portion 322 such that the horizontal seat portion 320 is in a plane and has a longitudinal axis along a length of the horizontal seat portion 320 from the vertical back portion 322. In addition, the vertical back portion 322 is in a plane and has a longitudinal axis along a length of the vertical back portion 322 from the horizontal seat portion 320. Moreover, the bracket 224 is positioned underneath the seat substantially parallel to the plane of the horizontal seat portion 320 and substantially perpendicular to the plane of the vertical back portion 322 and substantially perpendicular to both the longitudinal axis of the horizontal seat portion 320 and the longitudinal axis of the vertical back portion 322, the bracket 224 having a fastener receiving end 420 (as shown also in FIG. 7) along a longitudinal axis of the bracket 322, a first side end 250, a second side end 252, and a middle spacer 254, each of the first side end 250, second side end 252, and a middle spacer 254 substantially perpendicular to the fastener receiving end 420 and having a hole (256, 258, 260). The fastener receiving end 420 (as shown also in FIG. 7) includes ten slots 410, the ten slots separated in two groups of five slots 410 by the middle spacer 254, each slot coupled to a fastener of each exercising resistance member and the bracket 224. The elastic 220 belt coupled to the bracket 224 by being placed through each hole (256, 258, 260) of the first side end 250, second side end 252, and middle spacer 254 of the bracket 224 along the longitudinal axis of the bracket 224 and substantially parallel to the fastener receiving end 420 of the bracket 224, and the elastic belt 220 coupled to the flexible seat cover 401, the elastic belt 220 having a first end 216 and a second end 222 such that the elastic belt 220 is flexible to fit around the horizontal seat portion 320 and the bracket 224 is adjustable along a horizontal axis of the elastic belt 220 and the bracket 224 is adjustable around a radial axis of the elastic belt 220.

Figure 5:
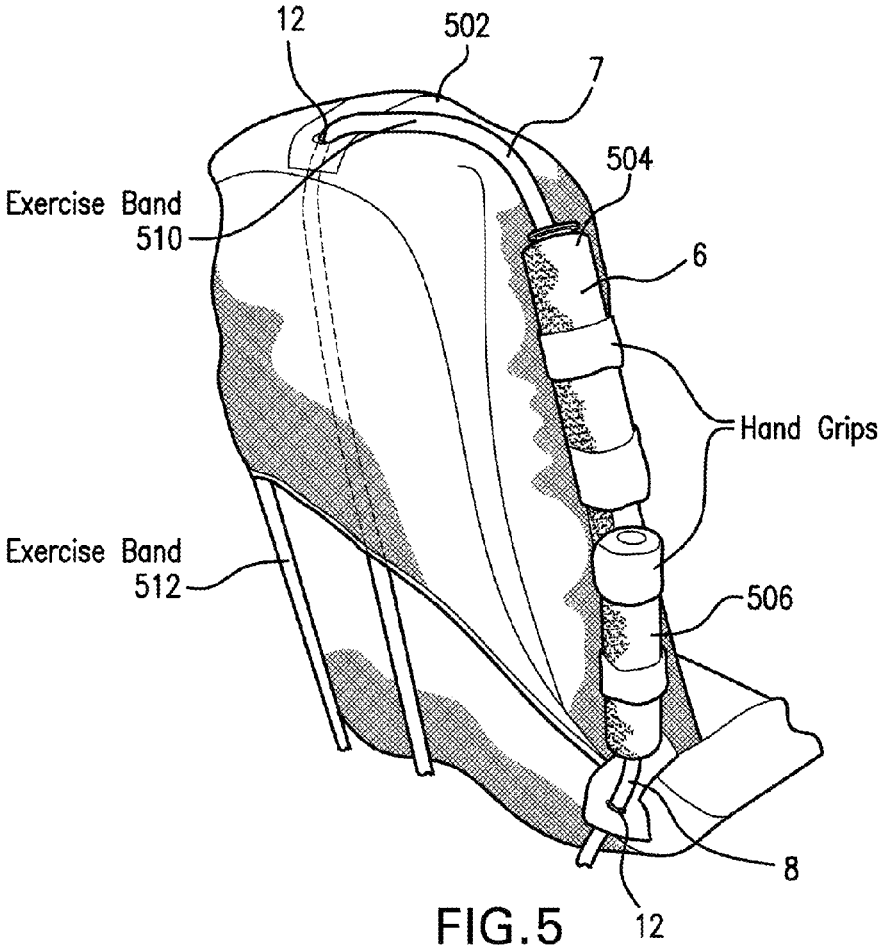
FIG. 5 is a close-up view of the upper aspect of the seat cover exercise device installed on a seat.

FIG. 5 depicts a close-up rear/oblique view of the upper portion of one embodiment of the seat cover exercise device 502 installed on a seat. The distal ends of resistance members (7,8) are attached to grips (6) (504 and 506), which may be removably attached to the seat cover by various methods, including Velcro. In this embodiment, a triceps resistance member for triceps/shoulder exercises at the level of the shoulders (7) passes through a grommet (12) at the top of the seat cover 502. A chest resistance member for chest exercises 510 at the level of the chest (8) also passes through a grommet (12) at the side of the seat cover 502. Note, the other chest resistance member 512 is shown as well.

Figure 6:
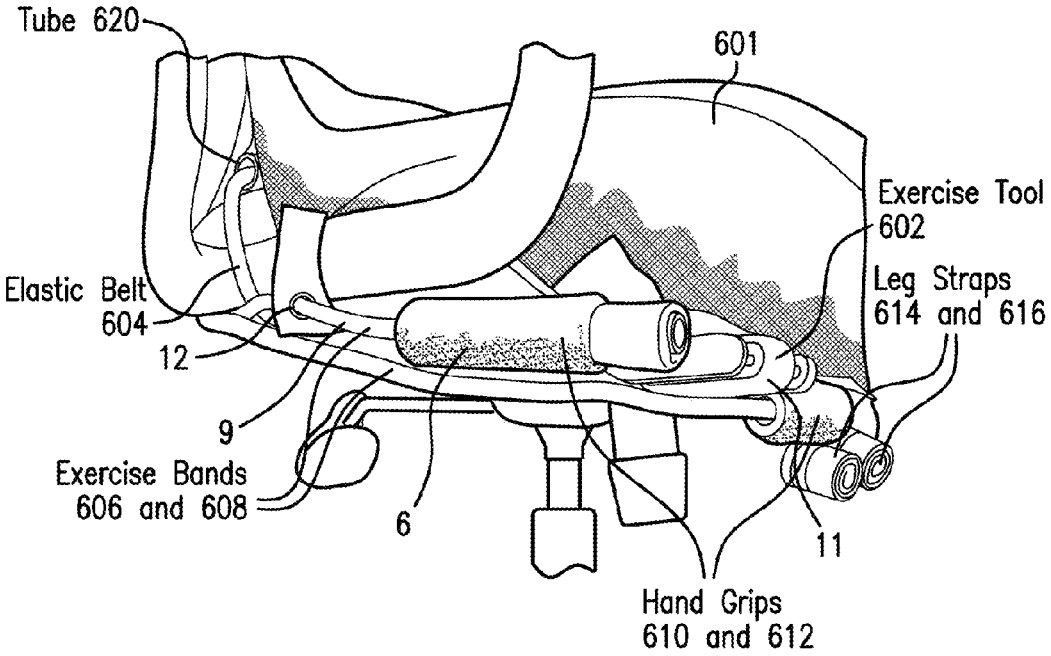
FIG. 6 is a close-up view of the lower aspect of the seat cover exercise device installed on a seat.

FIG. 6 depicts a close-up front/oblique view of the lower portion of one embodiment of the seat cover exercise device 601 installed on a seat. The distal ends of biceps resistance members or exercise bands (606 and 608) are attached to grips (6) (610 and 612). The grips may be removably attached to the seat cover by various methods, including Velcro. In this embodiment, a biceps resistance member at the level of the thighs (9) passes through a grommet (12) alongside the seat cover 601. Other exercise tools may be removably attached to seat cover exercise device, such as a hand grip tool (11). Further, the elastic belt 604 is coupled to a bracket (not shown) that wraps around the back or underside of the seat. In addition, legs straps (614 and 616) are shown. The distal ends of leg resistance members are attached to leg straps.

Figure 7:
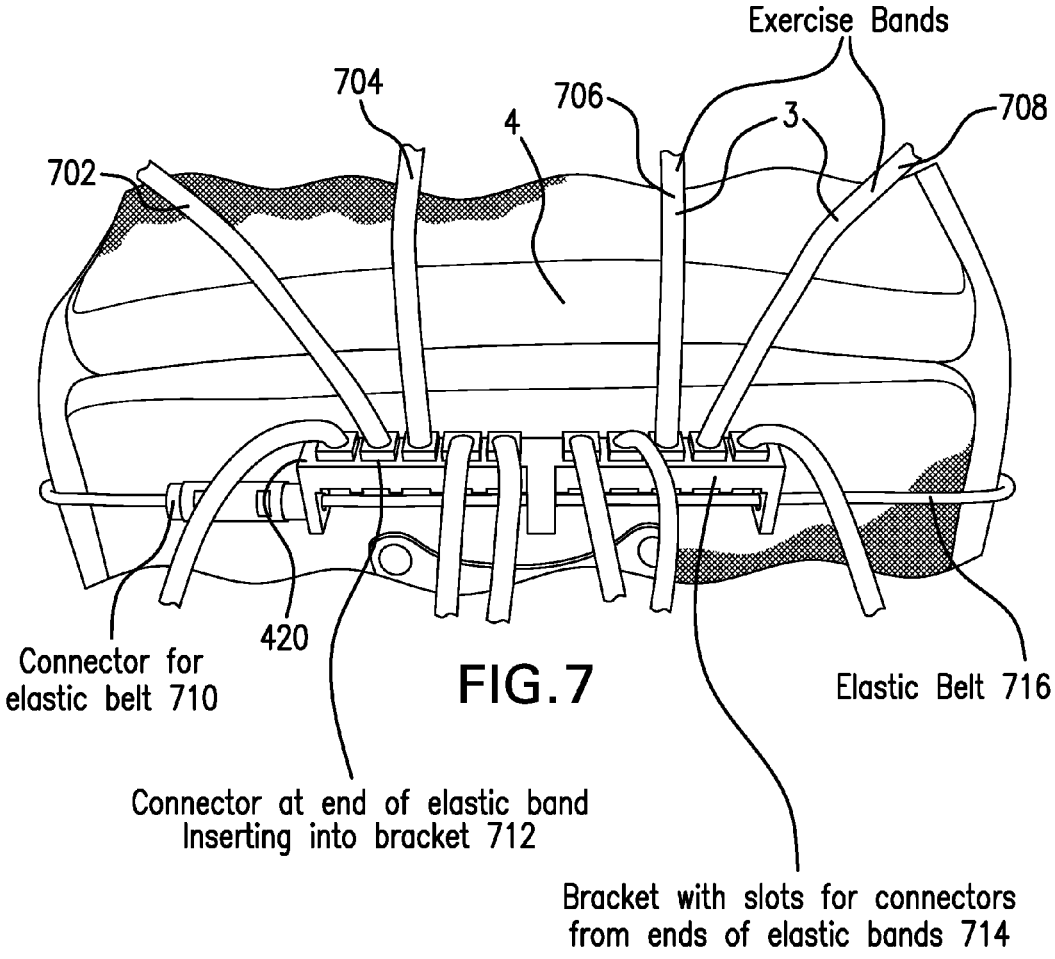
FIG. 7 is a close-up view of bottom aspect of the seat cover exercise device showing points of attachment for resistance members.

FIG. 7 depicts a close-up rear view of the point of attachment for resistance members in one embodiment of the exercise device 4 where the point of attachment is a bracket 714. Each of the resistance members or exercise bands (702, 704, 706, 708) are coupled to a connector 712 that is coupled to the bracket such that the brackets keeps the resistance members in place for a user to perform exercise with the device. Further, an elastic belt 716 for the bracket 714 is coupled to a connector for the elastic belt 710 to keep the bracket in place either to the underside or back of the seat.

Figure 8:
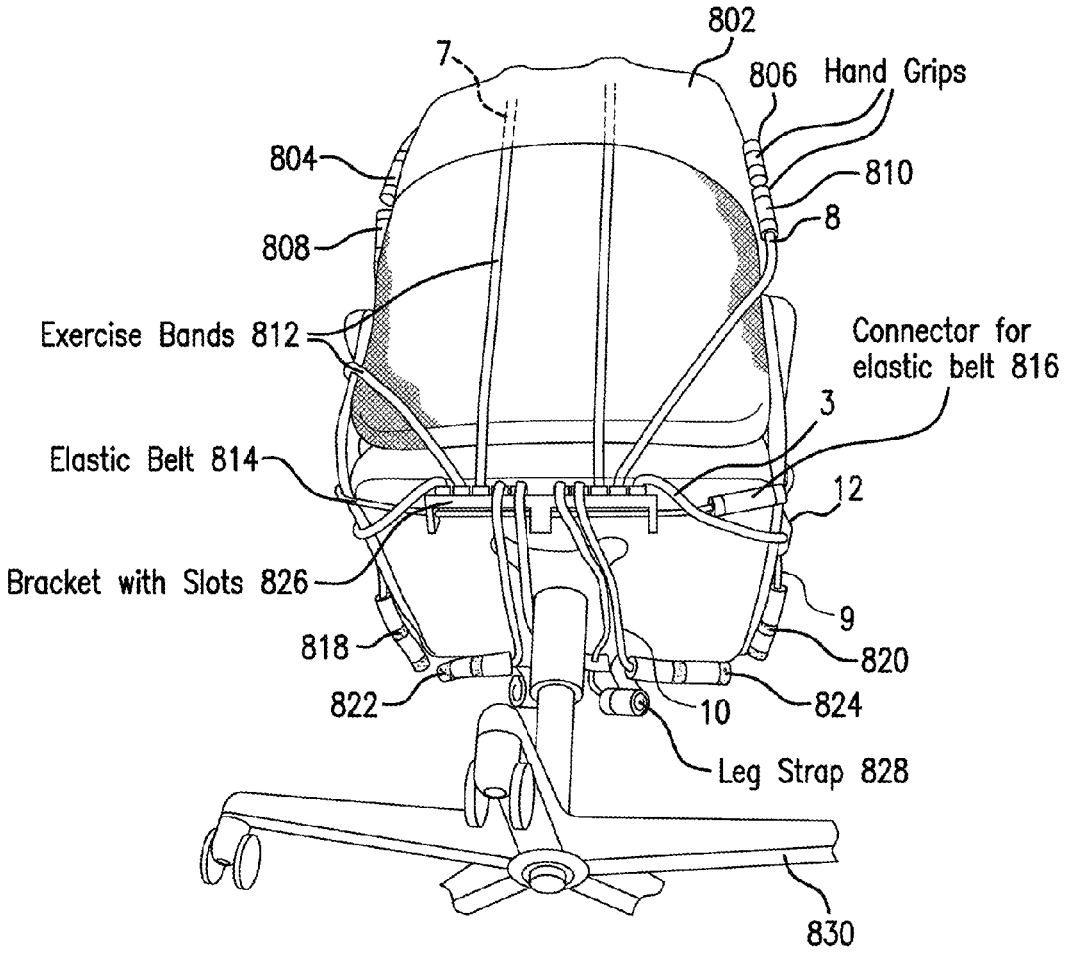
FIG. 8 is a bottom view of the seat cover exercise device installed on a seat.

FIG. 8 depicts a bottom view of one embodiment of the seat cover exercise device 802 installed on a chair 830. This provides a view of resistance members (3, 7, 8, 9, 10, 812) for the biceps, triceps/shoulder, chest, biceps, and back from their point of attachment (bracket 826) to positions along the sides of the seat cover and underneath the seat cover. Further, the resistance members may be coupled to respective grips/straps (804, 806, 808, 810, 818, 820, 822, 824, 828) Pictured in this view is a bracket 826 to which the proximal end of resistance members (3) may be fastened by one or more connectors. Visible are triceps/shoulder resistance members at the level of the shoulders (7), chest resistance members at the level of the chest (8), biceps resistance members at the level of the thighs (9) and back resistance members at the level of the knees (10). In this embodiment, the biceps resistance member at the level of the thighs (9) passes through a grommet (12) alongside the seat cover. Also visible are additional exercise tools or devices that are removably attached to the seat cover. In addition, the bracket is kept in place be an elastic belt 814 coupled to a connector 816 underneath the seat 830.

Figure 9:
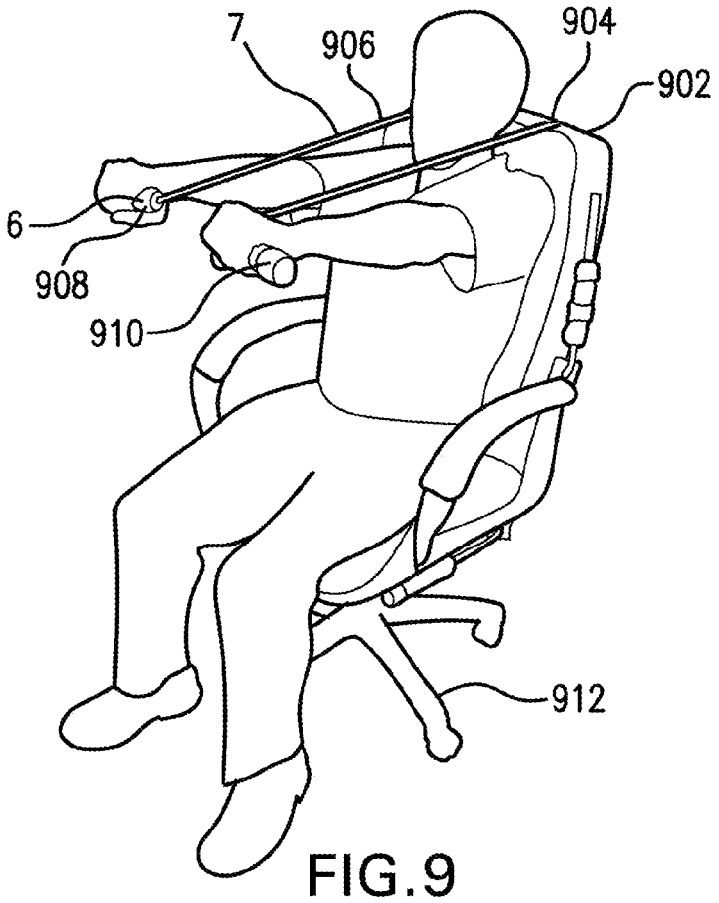
FIG. 9 shows a user performing a triceps/shoulder exercise with the seat cover exercise device.

FIG. 9 depicts a user performing a triceps/shoulder exercise with one embodiment of the seat cover exercise device 902 installed on a chair 912. The user is grasping two grips (6) (908 and 910), which are attached to triceps resistance members (904 and 906) at the user's shoulder level (7).

Figure 10:
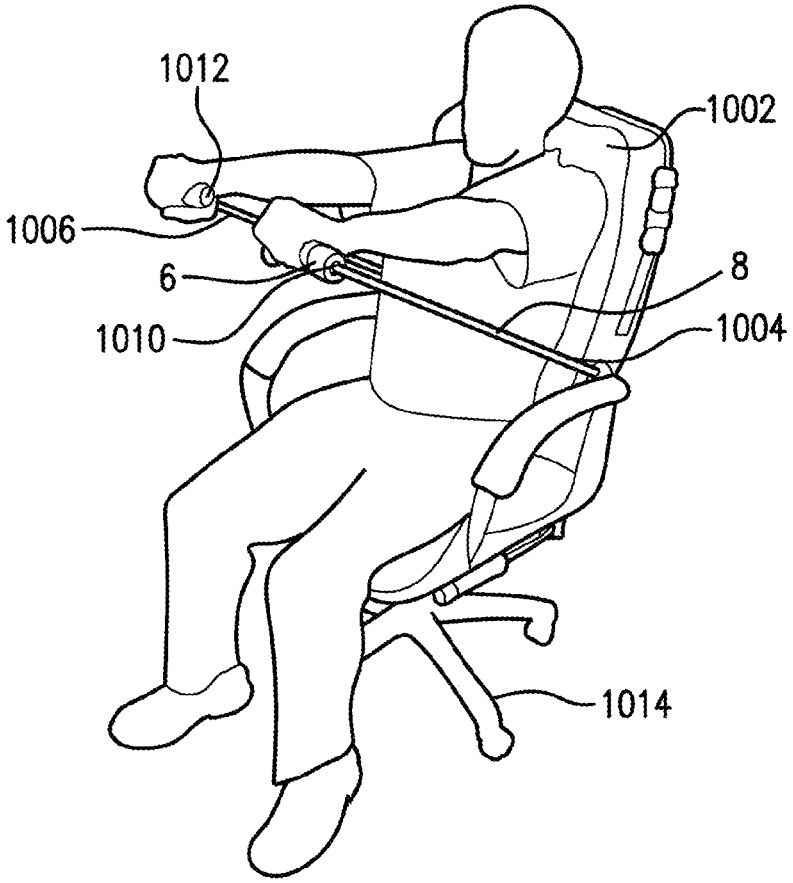
FIG. 10 shows a user performing a chest exercise with the seat cover exercise device.

FIG. 10 depicts a user performing a chest exercise with one embodiment of the seat cover exercise device 1002 installed on a chair 1014. The user is grasping two grips (6) (1010 and 1012), which are attached to chest resistance members (1004 and 1006) at the user's chest level (8).

Figure 11:
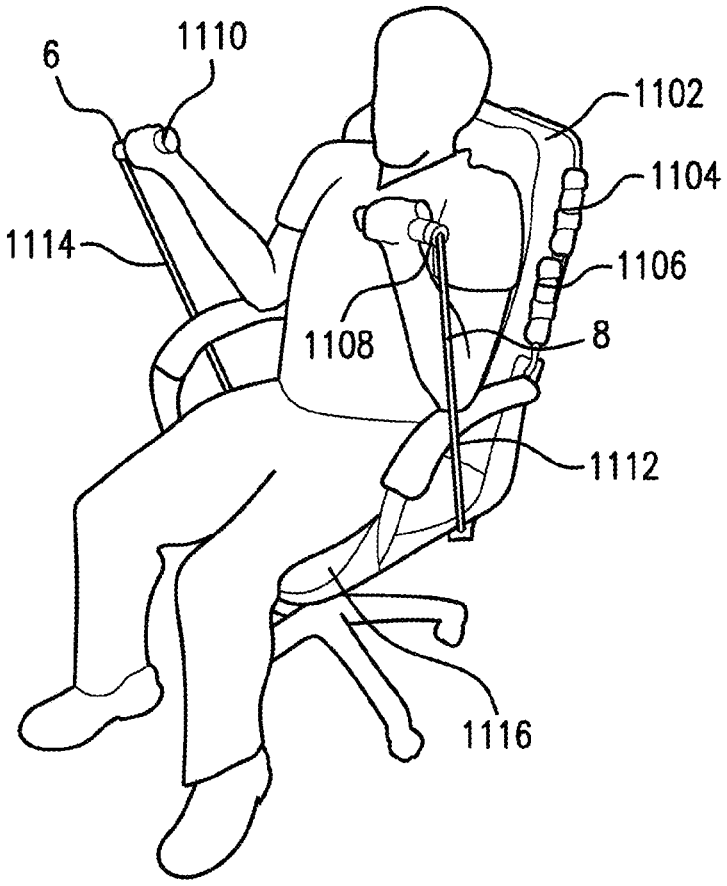
FIG. 11 shows a user performing a biceps exercise with the seat cover exercise device.

FIG. 11 depicts a user performing a biceps exercise with the seat cover exercise device 1102 installed on a chair 1116. The user is grasping two grips (6) (1108 and 1110), which are attached to resistance members (8, 1112 and 1114) at the user's knee level. Other grips (1104 and 1106) are shown that may be for the user to perform other types of exercises.

Figure 12:
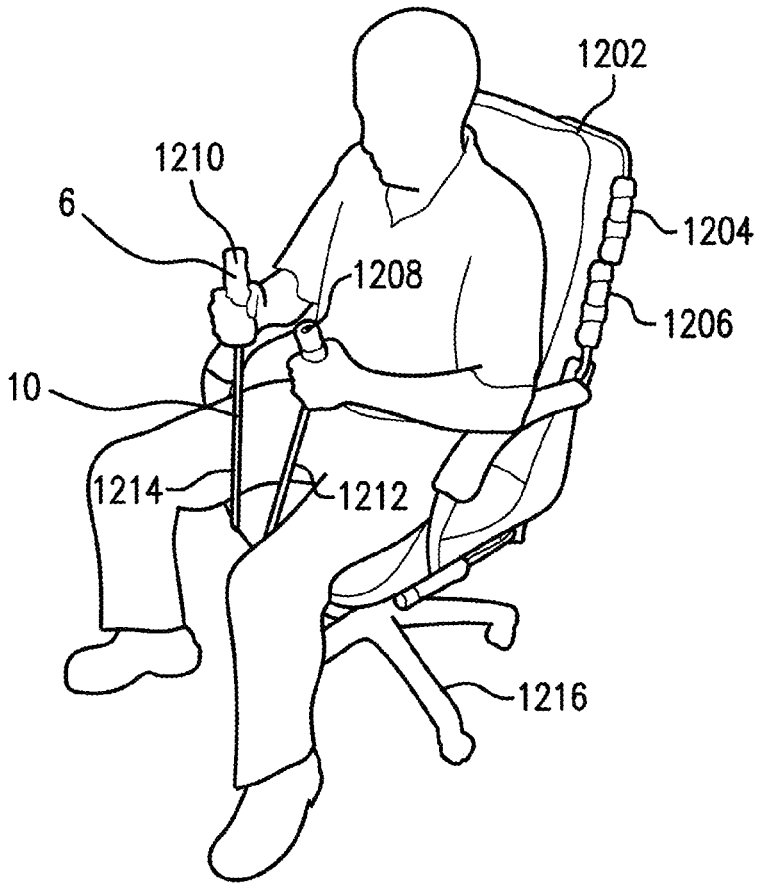
FIG. 12 shows a user performing a back exercise with the seat cover exercise device.

FIG. 12 depicts a user performing a back pull exercise with the seat cover exercise device 1202 installed on a chair 1216. The user is grasping two grips (6) (1208 and 1210), which are attached to resistance members (1212 and 1214) at the user's knee level (10). Other grips (1204 and 1206) are shown that may be for the user to perform other types of exercises.

Figure 13:
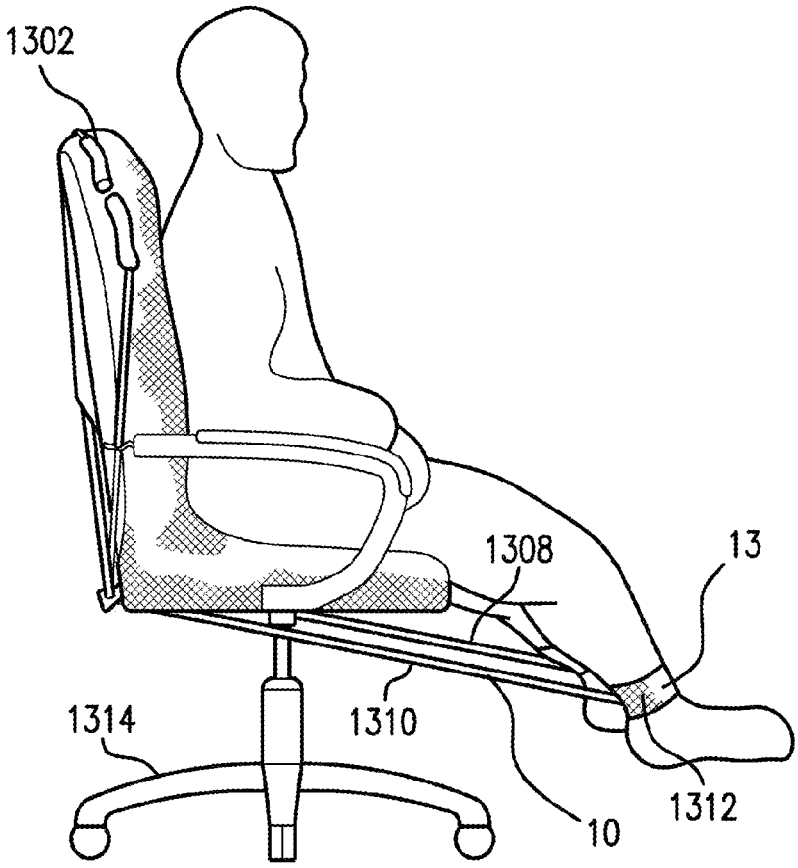
FIG. 13 shows a user performing a leg exercise with the seat cover exercise device.

FIG. 13 depicts a user performing a leg exercise with the seat cover exercise device 1302 installed on a seat 1314. The user has put each leg in a loop (13) (1312) (or a leg strap wrapped around the leg or ankle) attached to leg resistance members (1308 and 1310) at the user's knee level (10) and is performing a leg extension.

Figure 14:
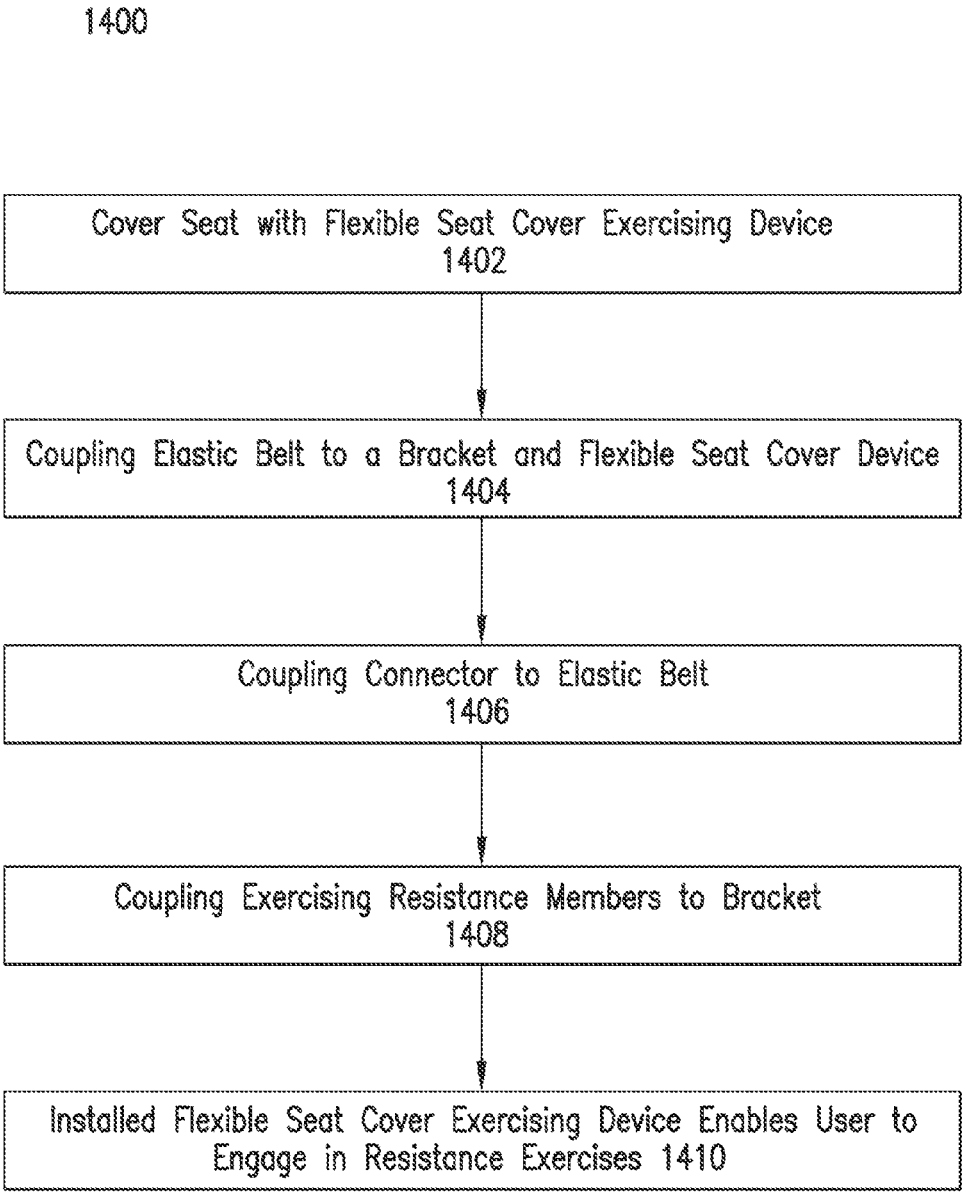
FIG. 14 is an example flowchart of an example method of installing and using flexible seat cover exercising device.

FIG. 14 is an example flowchart of an example method 1400 of installing and using flexible seat cover exercising device. The method 1400 includes covering a seat with a flexible seat cover exercising device, the seat having a horizontal seat portion and a vertical back portion, as shown in block 1402. The method 1400 further includes fastening an elastic belt from the flexible seat cover exercising device around the back or underside of a seat or chair to secure the seat cover exercising device onto the seat or chair. The elastic belt is coupled to a bracket and to the flexible seat cover exercising device. The elastic belt having a first end and a second end wherein the elastic belt is capable of adjusting placement of the bracket with respect to the flexible seat cover exercising device, shown in block 1404. The method 1400 additionally includes coupling a connector from the first end of the elastic belt to the second end of the elastic belt to form a closed loop around the seat or chair, as shown in block 1406. The bracket which is also attached to the elastic belt, is horizontally moveable along the axis of the belt and can also swivel around the axis of the belt. This allows for significant flexibility in installing and conforming the device to various types and sizes of seats and chairs. It is therefore capable of adjusting placement of the bracket with respect to the flexible seat cover exercising device. Moreover, the method 1400 includes coupling one or more exercising resistance members, each having a first end and a second end, to the bracket using one or more fasteners such that the first end of the one or more exercising resistance members are coupled to the bracket and the second end of the one or more exercising resistance member is coupled to a grip, as shown in block 1408. In addition, the flexible seat cover exercising device, when installed on a seat, enables a user seated thereon to engage in resistance exercises by grasping said grip and extending said exercising resistance member, as shown in block 1410.

In another embodiment, the grips coupled to the resistance members may be removably from seat cover with Velcro or some other fastener known in the art. In a further embodiment, a logo, advertisement, graphics, or text may be adhered to the seat cover. In an additional embodiment, one or more sensors may be coupled to the seat cover that may be used to monitor vital signs of the user.

The foregoing is illustrative only and is not intended to be in any way limiting. Reference is made to the accompanying drawings, which form a part hereof. In the drawings, similar symbols typically identify similar components, unless context dictates otherwise.

Note that the functional blocks, methods, devices and systems described in the present disclosure may be integrated or divided into different combination of systems, devices, and functional blocks as would be known to those skilled in the art.

In general, it should be understood that the circuits described herein may be implemented in hardware using integrated circuit development technologies, or yet via some other methods, or the combination of hardware and software objects that could be ordered, parameterized, and connected in a software environment to implement different functions described herein. For example, the present application may be implemented using a general purpose or dedicated processor running a software application through volatile or non-volatile memory. Also, the hardware objects could communicate using electrical signals, with states of the signals representing different data.

It should be further understood that this and other arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions, or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., " a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., " a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed:

1. An exercise device comprising, (a) a flexible seat cover configured to conform to a seat, the seat having a horizontal seat portion and a vertical back portion wherein the horizontal seat portion is in a first plane and has a longitudinal axis along a length of the horizontal seat portion from the vertical back portion and wherein the vertical back portion is in a second plane and has a longitudinal axis along a length of the vertical back portion from the horizontal seat portion;

(b) a plurality of exercising resistance members, each having a first end and a second end;

(c) one or more fasteners, each fastener coupled to each first end of each of the plurality of exercising resistance members;

(d) a bracket, positioned underneath the seat substantially parallel to the first plane of the horizontal seat portion and substantially perpendicular to the second plane of the vertical back portion and substantially perpendicular to both the longitudinal axis of the horizontal seat portion and the longitudinal axis of the vertical back portion, the bracket having a fastener receiving end along a longitudinal axis of the bracket, the bracket comprising a first side end, a second side end, and a middle spacer, each of the first side end, second side end, and middle spacer substantially perpendicular to the fastener receiving end and having a hole, wherein the fastener receiving end includes ten slots, the ten slots separated in two groups of five slots by the middle spacer, each slot coupled to each fastener and the bracket;

(e) an elastic belt coupled to the bracket by being placed through each hole of the first side end, second side end, and middle spacer of the bracket along the longitudinal axis of the bracket and substantially parallel to the fastener receiving end of the bracket, and the elastic belt coupled to the flexible seat cover, the elastic belt having a first end and a second end and wherein the elastic belt is flexible to fit around the horizontal seat portion and the bracket is adjustable along a horizontal axis of the elastic belt and the bracket is adjustable around a radial axis of the elastic belt;

(f) a connector coupled to the first end of the elastic belt and the second end of the elastic belt;

(g) a plurality of grips each of which is coupled to the second end of a first subset of exercising resistance members;

(h) a plurality of straps each of which is coupled to the second end of a second subset of exercising resistance members; and (i) wherein the exercise device, when installed on the seat, enables a user seated thereon to engage in resistance exercises by grasping the plurality of grips and extending said first subset of exercising resistance members.

2. The device of claim 1, wherein the plurality of exercising resistance members include a plurality of triceps/shoulder resistance members capable of exercising one or more triceps muscles.

3. The device of claim 1, wherein the plurality of exercising resistance members include a plurality of chest resistance members capable of exercising one or more chest muscles.

4. The device of claim 1, wherein the plurality of exercising resistance members include a plurality of biceps resistance members capable of exercising one or more biceps muscles.

5. The device of claim 1, wherein the plurality of exercising resistance members include a plurality of back resistance members capable of exercising one or more back muscles.

6. The device of claim 1, wherein the plurality of exercising resistance members include a plurality of leg resistance members capable of exercising one or more leg muscles.

7. The device of claim 1, wherein the first subset of the plurality of exercising members includes a plurality of triceps resistance members, a plurality of chest resistance members, a plurality of biceps resistance member, and a plurality of back resistance members.

8. The device of claim 1, wherein the second subset of the plurality of exercising members includes a plurality of leg resistance members.

9. The device of claim 1, wherein each exercising resistance member is elongated and extensible.

10. The device of claim 1, wherein each exercising resistance member includes a member elastic band and a resilient submember.

11. The device of claim 1, wherein each exercising resistance member is removably attached to the bracket by each fastener coupled to the first end of each exercising resistance member.

12. The device of claim 4 wherein upon installation on the seat having said horizontal seat portion and said vertical back portion, each biceps resistance member extends from a point of attachment to the bracket laterally along the sides of said horizontal seat portion.

13. The device of claim 5 wherein upon installation on the seat having said horizontal seat portion and said vertical back portion, each back resistance member extends from a point of attachment to the bracket laterally along sides of said horizontal seat portion.

14. The device of claim 3 wherein, upon installation on the seat having the horizontal seat portion and the vertical back portion, each chest resistance member extends from its point of attachment laterally along sides of said vertical back portion.

15. The device of claim 6 wherein, upon installation on the seat having said horizontal seat portion and said vertical back portion, each leg resistance member extends from its point of attachment across an underside of said horizontal seat portion.

16. The device of claim 2 wherein, upon installation on the seat having said horizontal seat portion and said vertical back portion, each triceps/shoulder resistance member extends from its point of attachment across a top of said vertical back portion.

17. The device of claim 1, further comprising at least one measuring apparatus capable of measuring one or more vital signs of the user.

18. A method comprising:

covering a seat with a flexible seat cover exercising device, the seat having a horizontal seat portion and a vertical back portion wherein the horizontal seat portion is in a first plane and has a longitudinal axis along a length of the horizontal seat portion from the vertical back portion and wherein the vertical back portion is in a second plane and has a longitudinal axis along a length of the vertical back portion from the horizontal seat portion;

coupling a first end of an elastic belt and a second end of the elastic belt to a connector on a bracket, to form a loop around the seat, wherein a position of the bracket is adjustable along the elastic belt with respect to the flexible seat cover exercising device and wherein the bracket is positioned underneath the seat substantially parallel to the first plane of the horizontal seat portion and substantially perpendicular to the second plane of the vertical back portion and substantially perpendicular to both the longitudinal axis of the horizontal seat portion and the longitudinal axis of the vertical back portion, the bracket having a fastener receiving end along a longitudinal axis of the bracket, the bracket comprising a first side end, a second side end, and a middle spacer, each of the first side end, second side end, and middle spacer substantially perpendicular to the fastener receiving end and having a hole, wherein the fastener receiving end includes ten slots, the ten slots separated in two groups of five slots by the middle spacer, each slot coupled to each of one or more fasteners and the bracket and the elastic belt is coupled to the bracket through each hole of the first side end, second side end, and middle spacer of the bracket along the longitudinal axis of the bracket and substantially parallel to the fastener receiving end of the bracket, and the elastic belt coupled to the flexible seat cover, the elastic belt having said first end and said second end and wherein the elastic belt is flexible to fit around the horizontal seat portion and the bracket is adjustable along a horizontal axis of the elastic belt and the bracket is adjustable around a radial axis of the elastic belt;

coupling one or more exercising resistance members, each having a first end and a second end, to the slots in the bracket using the one or more fasteners wherein the first end of the one or more exercising resistance members are coupled to the bracket and the second end of the one or more exercising resistance member is coupled to a grip; and wherein the flexible seat cover exercising device, when installed on the seat, enables a user seated thereon to engage in resistance exercises by grasping said grip and extending said one or more exercising resistance members.

19. The device of claim 1, wherein the bracket is positioned under the horizontal seat portion and the slots are facing toward a rear of the seat thereby allowing at least a portion of each exercising resistance member to traverse at least one of a portion of the vertical back portion and a portion of the horizontal seat portion.

20. The method of claim 18, wherein the bracket is positioned under the horizontal seat portion and the slots are facing toward a rear of the seat thereby allowing at least a portion of each exercising resistance member to traverse at least one of a portion of the vertical back portion and a portion of the horizontal seat portion.

* * * * *